United States Patent [19]

Ekman

[11] 4,335,604

[45] Jun. 22, 1982

[54] METHOD AND APPARATUS FOR THE IDENTIFICATION OF COINS OR EQUIVALENT

[75] Inventor: Timo J. Ekman, Vantaa, Finland

[73] Assignee: Cointest Oy, Helsinki, Finland

[21] Appl. No.: 183,810

[22] Filed: Sep. 3, 1980

[30] Foreign Application Priority Data

Sep. 3, 1979 [FI] Finland ..... 792729

[51] Int. Cl.[3] ..... G07F 3/02

[52] U.S. Cl. ..... 73/163; 194/100 A

[58] Field of Search ..... 73/163; 194/100 A; 324/239

[56] References Cited

U.S. PATENT DOCUMENTS 3,152,677 10/1964 Phillips ..... 194/100 A 3,599,771 8/1971 Hinterstocker ..... 194/100 A

FOREIGN PATENT DOCUMENTS 1170417 of 1969 United Kingdom .

*Primary Examiner*—James J. Gill

*Attorney, Agent, or Firm*—Finnegan, Henderson, Farabow, Garrett & Dunner

[57] ABSTRACT

A method and an apparatus for testing and identifying electrically conductive discs, such as coins or equivalent. According to the method the effect of each coin on a magnetic field generated by means of coils is measured, the measurement result obtained in this way is compared with the reference value, and the coin is accepted if the measured value is close enough to the reference value. The reference value is determined on the basis of the effect produced by a preselected reference coin upon a magnetic field preferably of the same magnitude as the magnetic field to be measured. The magnitude of the magnetic field is measured in two directions at least substantially perpendicular to each other and the effect of the coin upon the symmetry of the magnetic field to be measured is taken into account by means of an additional coil placed at least substantially in the symmetry plane of the magnetic field to be measured.

8 Claims, 5 Drawing Figures

METHOD AND APPARATUS FOR THE IDENTIFICATION OF COINS OR EQUIVALENT

The present invention concerns a method for testing and identifying electrically conductive coins or equivalent, according to which method the effect of each coin on a magnetic field generated e.g., by means of coils is measured, the measurement result obtained in this way is compared with a reference value, the coin is accepted if the measured value is close enough to the reference value, and the reference value is determined on the basis of the effect produced by a preselected reference coin upon a magnetic field preferably of the same magnitude as the magnetic field to be measured.

The invention also concerns an apparatus for carrying out this method, said apparatus comprising means for generating a magnetic field of measurement, means for guiding the coins to be examined into the range of influence of the magnetic field of measurement, means for generating a magnetic field of reference, said magnetic field of reference being preferably of the same magnitude as the magnetic field of measurement, means for comparing the magnetic field of measurement with the magnetic field of reference, and a preselected coin positioned in the magnetic field of reference, which reference coin is preferably identical with the coins to be identified (accepted).

In the method of measurement in accordance with the earlier co-pending U.S. patent application Ser. No. 06/138,566, filed Apr. 8, 1980, the location of the coin to be measured is not observed when the measurement is performed. It follows from this that, since the measurement results with various coins may also resemble each other in such situations in which the coin to be measured is not located in the same way in relation to the measurement element as the reference coin is located in relation to the corresponding reference element, therefore the precision of the method can be improved by using a locating method in accordance with the present invention for locating.

An object of the present invention is to improve the method and apparatus in accordance with the above earlier application in the above respect in order to achieve higher selecting precision.

The invention is based on the idea that in the measurement element in accordance with the above earlier application there is symmetry in the magnetic field of the element in the middle of the coin channel in relation to the plane perpendicular to the channel only if there is no coin at all within the range of the element, or if the coin is in a symmetrical position in relation to the plane mentioned above. If a coil is now arranged on one side of the coin channel and the coil is positioned in the symmetry plane or almost in the symmetry plane, a signal is obtained from this coil when there is asymmetry.

In the method and apparatus in accordance with the invention, a signal obtained from the locating coil positioned in the way mentioned above is used in order to prevent acceptance of a coin to be measured if the coin is not in the middle of the coin channel with the desired precision.

Thus, according to one aspect of the method, the effect of a coin upon the symmetry of a magnetic field is measured, this symmetry is examined by means of a measurement coil placed in the symmetry plane of said magnetic field, the symmetry is established on the basis of the amplitude of the signal received from the measurement coil, and on the basis of symmetry, a signal is formed which is coupled to a measurement arrangement described in the above-mentioned co-pending patent application so that acceptance of the coin takes place only when there is symmetry.

More specifically, the method in accordance with the present invention is mainly characterized in that the magnitude of the magnetic field is measured in two directions at least substantially perpendicular to each other so that, by means of an additional coil placed at least substantially in the symmetry plane of the magnetic field to be measured, the measurement moment of the coin is determined on the basis of the effect of the coin on the symmetry of the magnetic field to be measured, such that the measurement is carried out at a location where there is a local extreme value, as a function of the position of the coin, in the amplitude of the signal received from the additional coil due to the effect of the coin.

The apparatus in accordance with the present invention is characterized by at least one additional measurement coil arranged at least substantially into the symmetry plane of the magnetic field to be measured, so as to take into account the effect of the coin upon the symmetry of the magnetic field to be measured.

The invention will be examined in more detail with the aid of the exemplifying embodiments illustrated in the attached drawings.

Below, the notion of coin has been used as meaning metal coins, counters, tokens, or any other objects that may be used or whose use may be attempted in coin-operated apparatuses.

Figure 1:
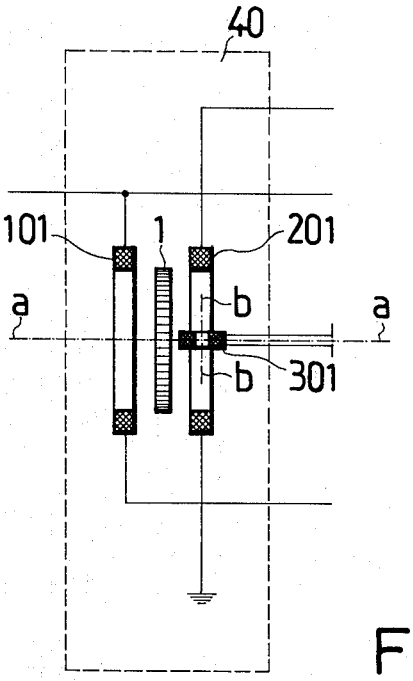
FIG. 1 shows a first coil arrangement in accordance with the present invention.
Figure 3:
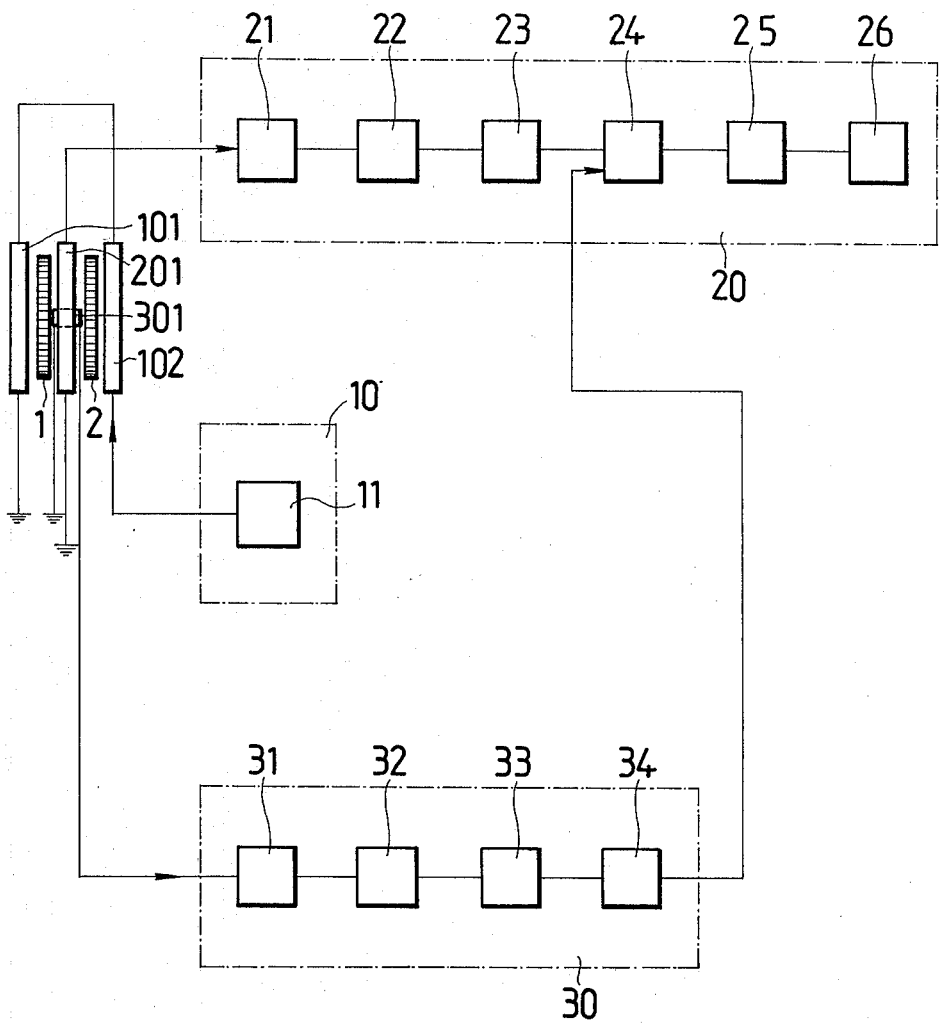
FIG. 3 is a schematical presentation of an apparatus in accordance with the present invention.

The additional apparatus in accordance with the present invention operates, for example, when two or more coil arrangements in accordance with FIG. 3 in the above-mentioned co-pending application are used, out of which coil arrangements preferably the coil arrangement used for measuring the coin to be tested is provided with a locating coil 301 in accordance with FIG. 1, which locating coil is positioned symmetrically or substantially symmetrically in relation to the planes a-a and b-b. When passing in the measurement channel, the coin 1 produces a magnetic flow passing through the locating coil 301 by distorting the symmetry of the magnetic field of the arrangement 40. Then, it can be concluded from the phase of the signal induced in the coil 301 on what side of the plane a-a the coin to be measured is at each particular moment of time. If the coin is positioned precisely symmetrically in relation to the plane a-a, the amplitude of the signal received from the coil 301 approaches zero. An indication concerning this can be passed most appropriately to the level indicator 24 (FIG. 3) whereby acceptance of the coin is prevented unless the measurement result has been obtained when the coin is, with an appropriate precision, located symmetrically in relation to the plane a-a.

If the coil is placed so that there is an appropriate, small angle between the plane a-a and the coil 301, the level-indicator circuit gives an indication both when the coin is positioned substantially symmetrically in relation to the symmetry plane a-a and when the coin is appropriately far on the other side of the coil arrangement. On the contrary, no indication is received when there is no coin near the measurement-coil arrangement 40. Moreover, said second indication can be used for finding out the direction of movement of the coin.

The angle of coil 301 to the symmetry plane a-a is preferably between 1° and 15°. Within this range, an angle of between 2° and 10° is preferable and most preferably the angle should be between 3° and 6°.

FIG. 3 shows as a block diagram the locating coupling of the apparatus in accordance with the present invention. In the locating process the signal received from the locating coil 301 is amplified by the amplifier 31 and indicated by the indicator 32. The signal received from the indicator 32 is integrated in the integrator 33 the output of which is examined by means of the level indicator 34 yielding the above locating signal for use, e.g., as shown in FIG. 3, in connection with the level indicator 24 so that a signal can be received by the monostable multivibrator 25 only during a locating signal.

The locating signal can, in addition, be used separately, for example, in connection with additional equipment possibly coupled to the circuitry, such as a microprocessor system, among other things, in order to produce interruptions.

Figure 2:
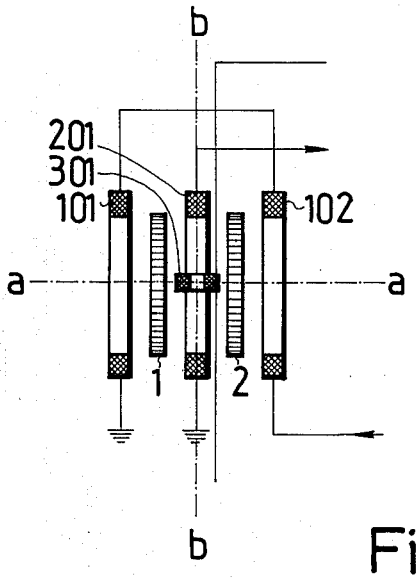
FIG. 2 shows a second arrangement coil in accordance with the present invention.

In the coil arrangement in accordance with FIG. 2, the additional apparatus in accordance with the invention is connected to an apparatus in accordance with FIG. 2 in the above-mentioned co-pending application. In such a case, it is possible to make the construction either symmetric in relation to the plane a-a or to place the reference coin 2 slightly aside from the symmetry plane. Then the minimum point both of the indicating signal and of the locating signal is correspondingly shifted so that both signals are at their minimum when the coin 1 to be measured is in the same position in relation to the plane a-a as the reference coin 2 is. By means of such an appropriate asymmetry it is possible to eliminate the locating signal when the coin to be measured is not at all in the proximity of the coil arrangement. In both cases it is possible, by means of the locating circuit, at the desired moment of measurement, to generate a signal in accordance with diagram 3 and diagram 4 to be used, for example, for keying the measurement in accordance with FIG. 3.

Figure 4:
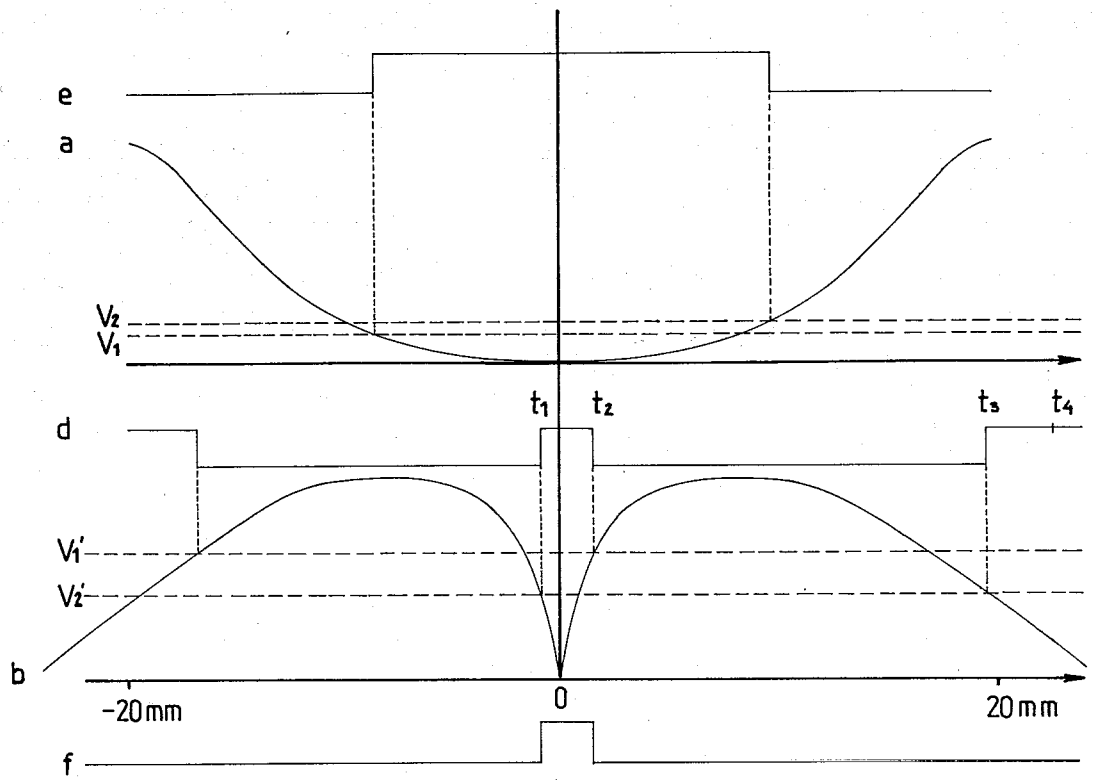
FIG. 4 shows graphically signal shapes occurring in the embodiment shown in FIG. 1.

FIG. 4 illustrates graphically the signals occurring in an embodiment shown in FIG. 1 of the apparatus in accordance with the present invention when a coin to be tested moves in the coin channel described, e.g., in the above-mentioned co-pending application. The values on the horizontal axis are distances between the centre point of the coin and the plane a-a. In this embodiment the maximum diameter of the coils in the measurement elements is 40 mm.

The curve a presents the amplitude of the signal received into the amplifier 21. From it the signal e can be formed in the level indicator 24. $V_1$ and $V_2$ are reference levels of the level indicator 24, and the difference in their levels illustrates the hysteresis of the indicator 24.

The curve b illustrates the amplitude of the signal received from the locating coil 301 as a function of the location of the coin to be measured. The locating signal d is derived from this signal by means of the locating circuit 30. The levels $V_1'$ and $V_2'$ are reference levels of the level indicator, and the hysteresis between them is preferably higher than the hysteresis between the levels $V_1$ and $V_2$ because the time constant of the integrator 33 is, owing to the high speeds of change of the amplitude of the signal b, lower than the time constant of the integrator 23. Out of the signals e and d, in the indicator 24, the acceptance signal f is generated for the monostable multivibrator 25. When a signal is desired only when the coin is in the middle of the measurement location, the signal can be reshaped by means of the monostable multivibrator 25 which is activated at the rising edge of the triggering signal $t_1$-$t_2$ and the retriggering of which is prevented till the moment $t_4$ ($t_4 > t_3$).

Figure 5:
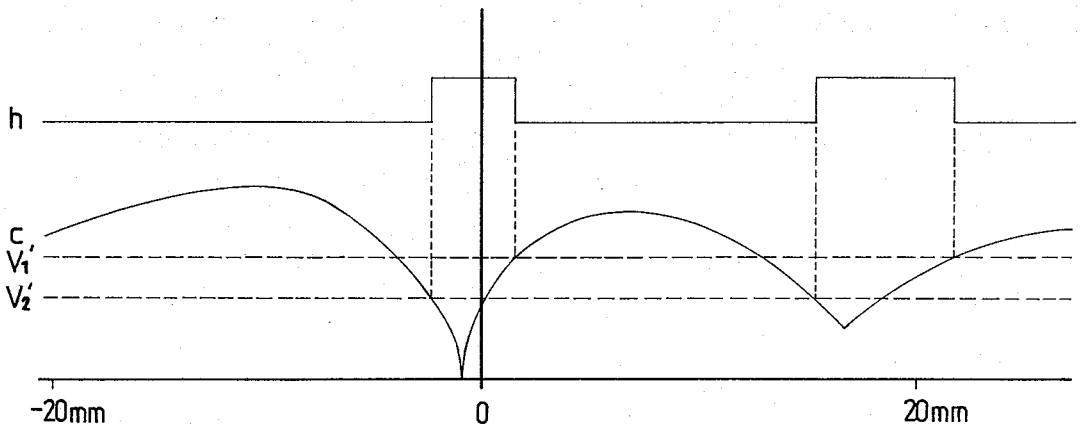
FIG. 5 shows graphically the operation of the locating circuit in the apparatus in accordance with the invention.

FIG. 5 illustrates the functioning of the locating circuit 30 when the locating coil 301 is placed at an angle of 3.5° in relation to the plane a-a. Then, when the coin passes in the coin channel, the level indicator 34 yields two different locating impulses (signal g), one of them when the coin is substantially symmetrically placed in relation to the plane a-a and the other one when the coin is about half inside the measurement element. This second impulse is received only on one side of the element, so that it can be used for finding out the direction of movement of the coin.

I claim:

1. A method for testing and identifying electrically conductive discs such as coins, according to which method the effect of each disc on a magnetic field generated, e.g., by means of coils is measured, the measurement result obtained in this way is compared with a reference value, the disc is accepted if the measured value is close enough to the reference value, and the reference value is determined on the basis of the effect produced by a preselected reference disc upon a magnetic field preferably of the same magnitude as the magnetic field to be measured, wherein the magnitude of the magnetic field is measured in two directions at least substantially perpendicular to each other such that, by means of an additional coil placed at least substantially in the symmetry plane of the magnetic field to be measured, the measurement moment of each disc is determined on the basis of the effect of the disc on the symmetry of the magnetic field to be measured, such that the measurement is carried out at a location where there is a local extreme value, as a function of the position of the disc, in the amplitude of the signal received from the additional coil due to the effect of the disc.

2. A method as claimed in claim 1, wherein the additional coil is positioned into an angle of inclination of 1° to 15° in relation to the symmetry plane of the magnetic field to be measured.

3. A method as claimed in claim 2, wherein an angle of inclination of 2° to 10° is used.

4. A method as claimed in claim 3, wherein an angle of inclination of 3° to 6° is used.

5. An apparatus for testing and identifying electrically conductive discs, such as coins, comprising:

(a) means for generating a magnetic field of measurement;

(b) means for guiding the coins to be examined into the range of influence of the magnetic field of measurement;

(c) means for generating a magnetic field of reference, said magnetic field of reference being preferably of the same magnitude as the magnetic field of measurement;

(d) means for comparing the magnetic field of measurement with the magnetic field of reference;

(e) a preselected coin positioned in the magnetic field of reference, which reference coin is preferably identical with the coins to be identified (accepted); and (f) at least one additional measurement coil arranged at least substantially into the symmetry plane of the magnetic field to be measured so as to take into account the effect of the coin upon the symmetry of the magnetic field to be measured.

6. An apparatus as claimed in claim 5, wherein the additional coil is inclined 1° to 15° in relation to the symmetry plane.

7. An apparatus as claimed in claim 6, wherein the angle of inclination is 2° to 10°.

8. An apparatus as claimed in claim 7, wherein the angle of inclination is 3° to 6°.

* * * * *